United States Patent [19]

Muto

[11] Patent Number: 4,942,855

[45] Date of Patent: Jul. 24, 1990

[54] LUBRICATING SYSTEM OF A VALVE MECHANISM FOR A DOUBLE OVERHEAD CAMSHAFT ENGINE

[75] Inventor: Naoto Muto, Kawasaki, Japan

[73] Assignee: Fuji Jukogyo Kabushiki Kaisha, Tokyo, Japan

[21] Appl. No.: 425,801

[22] Filed: Oct. 23, 1989

[30] Foreign Application Priority Data

Oct. 29, 1988 [JP] Japan ..... 63-142187[U]

[51] Int. Cl.[5] ..... F01M 1/06

[52] U.S. Cl. ..... 123/90.33; 123/196 R; 184/6.5

[58] Field of Search ..... 123/90.27, 90.33, 90.34, 123/196 R; 184/6.5

[56] References Cited

U.S. PATENT DOCUMENTS 4,729,349 3/1988 Sonoda et al. ..... 123/90.34
4,834,219 5/1989 Inagaki et al. ..... 184/6.5
4,858,574 8/1989 Fukuo et al. ..... 123/90.34

FOREIGN PATENT DOCUMENTS 0211517 12/1983 Japan ..... 184/6.5
61-17408 7/1984 Japan .

*Primary Examiner*—David A. Okonsky
*Assistant Examiner*—Weilun Lo
*Attorney, Agent, or Firm*—Martin A. Farber

[57] ABSTRACT

A lubricating system has a main oil gallery provided for supplying pressurized oil, a first gallery connected with the main gallery for supplying first lubricating oil to the hydraulic valve-lash adjusters. A relief valve is provided for keeping pressure of the first lubricating oil constant. A second gallery is provided for supplying second lubricating oil to journals of the camshafts, and nozzles are provided for lubricating a camshaft and rocker arm for a valve disposed in an upper position than another valve.

3 Claims, 3 Drawing Sheets

LUBRICATING SYSTEM OF A VALVE MECHANISM FOR A DOUBLE OVERHEAD CAMSHAFT ENGINE

BACKGROUND OF THE INVENTION

The present invention relates to a valve mechanism for a double overhead camshaft (DOHC) engine with horizontally opposed cylinders, and more particularly to a lubricating system for valve mechanism. In accordance with requirement for increase of the power of the engine, the horizontally opposed cylinder engine with a DOHC type valve mechanism having a hydraulic valve-lash adjuster has been proposed. The valve mechanism comprises a cam, a rocker arm, and a hydraulic valve-lash adjuster, a hydraulic system for the hydraulic valve-lash adjuster, and a lubricating system for lubricating respective sliding portions. In particular, it is desirable to effectively circulate oil of the lubricating system including oil of the hydraulic system.

Japanese Utility Model Application Laid-Open No. 61-17408 discloses a lubricating system for a single overhead camshaft (OHC) engine in which oil is independently supplied to an oil gallery for a hydraulic valve-lash adjuster and a passage provided in a camshaft in the axial direction thereof. Surfaces of cams and journals of the camshaft are lubricated by oil through the passage in the camshaft.

If the system in the prior art is used for the valve mechanism for the double overhead camshaft (DOHC) engine, a large amount of oil must be used for the hydraulic valve-lash adjusters. Consequently, the amount of oil for lubrication become short.

In a horizontally opposed cylinder engine, it is necessary to keep pressure of oil constant for the valve-lash adjusters. Since spring load per valve reduces with reduction of the diameter of the valve, it is necessary to control the pressure of oil so as to prevent the valve from being pushed up by the valve-lash adjuster. Because the number of the camshafts in the DOHC engine increases, torque for driving the camshafts increases, so that tensile strength of a belt for the camshafts is increased. The increase of the tensile strength may occur seizure of the journals of the camshafts. Further, since the hydraulic valve-lash adjusters are upwardly or downwardly inclined with respect to the horizontal, oil is liable to leak during the stop of the engine.

SUMMARY OF THE INVENTION

The object of the present invention is to provide a lubricating system which may remove above mentioned disadvantages, thereby properly supplying oil and lubricating the valve mechanism.

According to the present invention, there is provided a lubricating system of a valve mechanism for a double overhead camshaft engine having opposed cylinder, an intake valve and an exhaust valve which are disposed in a vertical plane, camshafts, rocker arms, and hydraulic valve-lash adjusters.

The system has a main oil gallery provided for supplying pressurized oil to the valve mechanism, a first gallery connected with the main gallery for supplying first lubricating oil to the hydraulic valve-lash adjusters, means for keeping pressure of the first lubricating oil constant, a second gallery connected with the main gallery for supplying second lubricating oil to journals of the camshafts, a third gallery connected with the main gallery, nozzles connected with the third gallery for ejecting third lubricating oil to the camshaft and a rocker arm of the upper valve.

In an aspect of the invention, an orifice is provided in the first gallery for reducing the pressure of the first lubricating oil.

The other objects and features of this invention will become understood from the following description with reference to the accompanying drawings.

DETAILED DESCRIPTION OF THE PREFERRED EMBODIMENT

Figure 1:
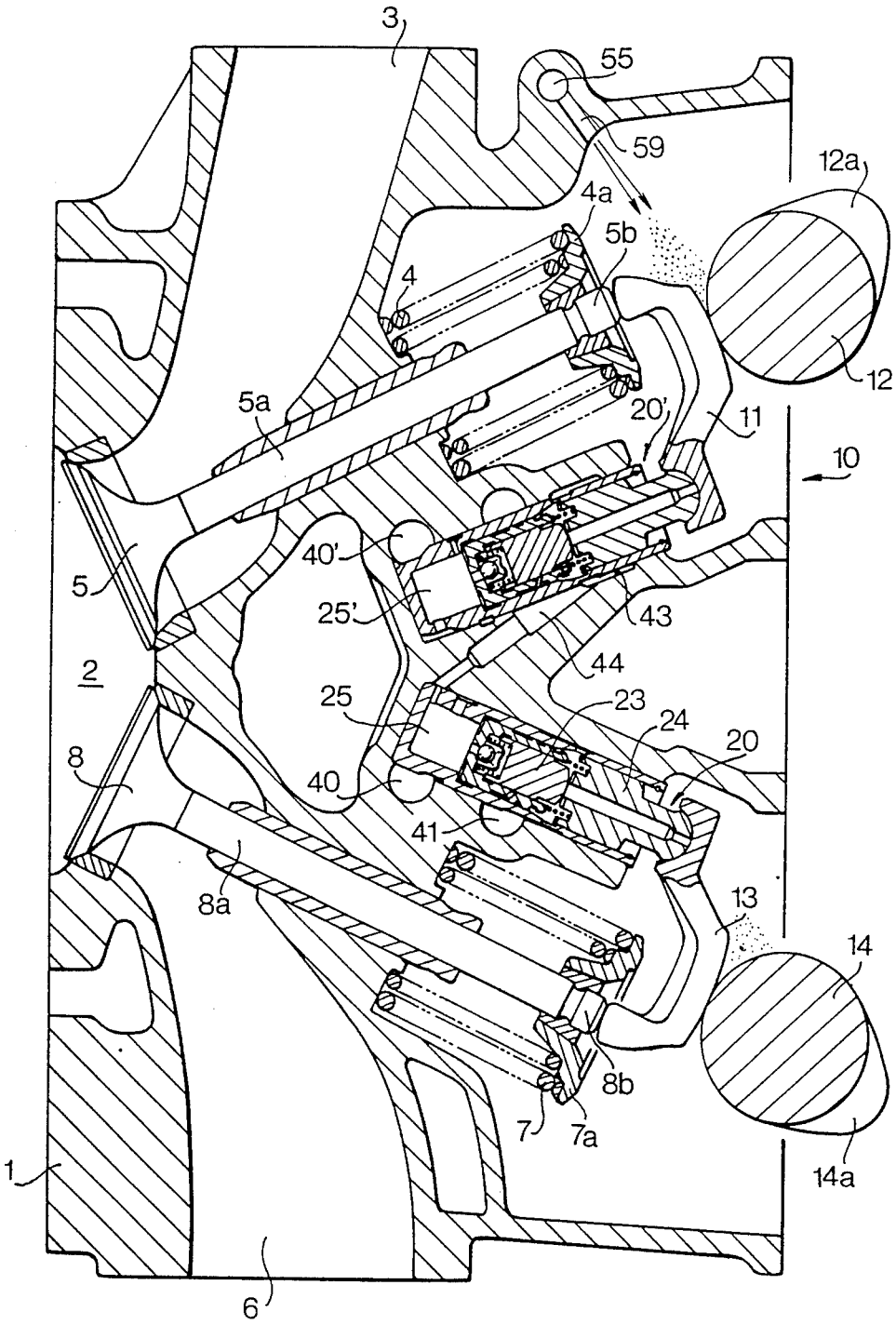
FIG. 1 is a sectional side view showing a valve mechanism for DOHC engine according to the present invention.

Referring to FIG. 1, numeral 1 designates a cylinder head at one of two banks of a horizontally opposed cylinder engine. A combustion chamber 2 of the cylinder communicates with an intake port 3 and an exhaust port 6 formed in the cylinder head. An intake valve 5 is provided to be upwardly inclined with respect to the horizontal. A valve spring 4 is provided between a flat of the cylinder head 1 and a retainer secured to a stem end **5*b*. An exhaust valve 8 provided with a spring 7 is downwardly inclined. A valve mechanism 10 consisting of a double overhead camshaft device is provided for operating both of the intake valve 5 and the exhaust valve 8. The intake valve 5 and exhaust valve 8** are disposed in a vertical plane.

In the valve mechanism 10, a hydraulic valve-lash adjuster 20' is mounted in the cylinder head 1 in parallel with a valve stem **5*a* of the intake valve 5. A rocker arm 11 supported by the hydraulic valve-lash adjuster 20' engages with the stem end 5*b* of the intake valve 5 and a cam 12*a* integral with a camshaft 12. A hydraulic valve-lash adjuster 20 is mounted in the cylinder head 1 in parallel with a stem 8*a* of the exhaust valve 8. A rocker arm 13 engages with a stem end 8*b* of the exhaust valve 8 and with a cam 14*a* on a camshaft 14**.

The hydraulic valve-lash adjuster 20 for the exhaust valve 8 will be described hereinafter.

Figure 2:
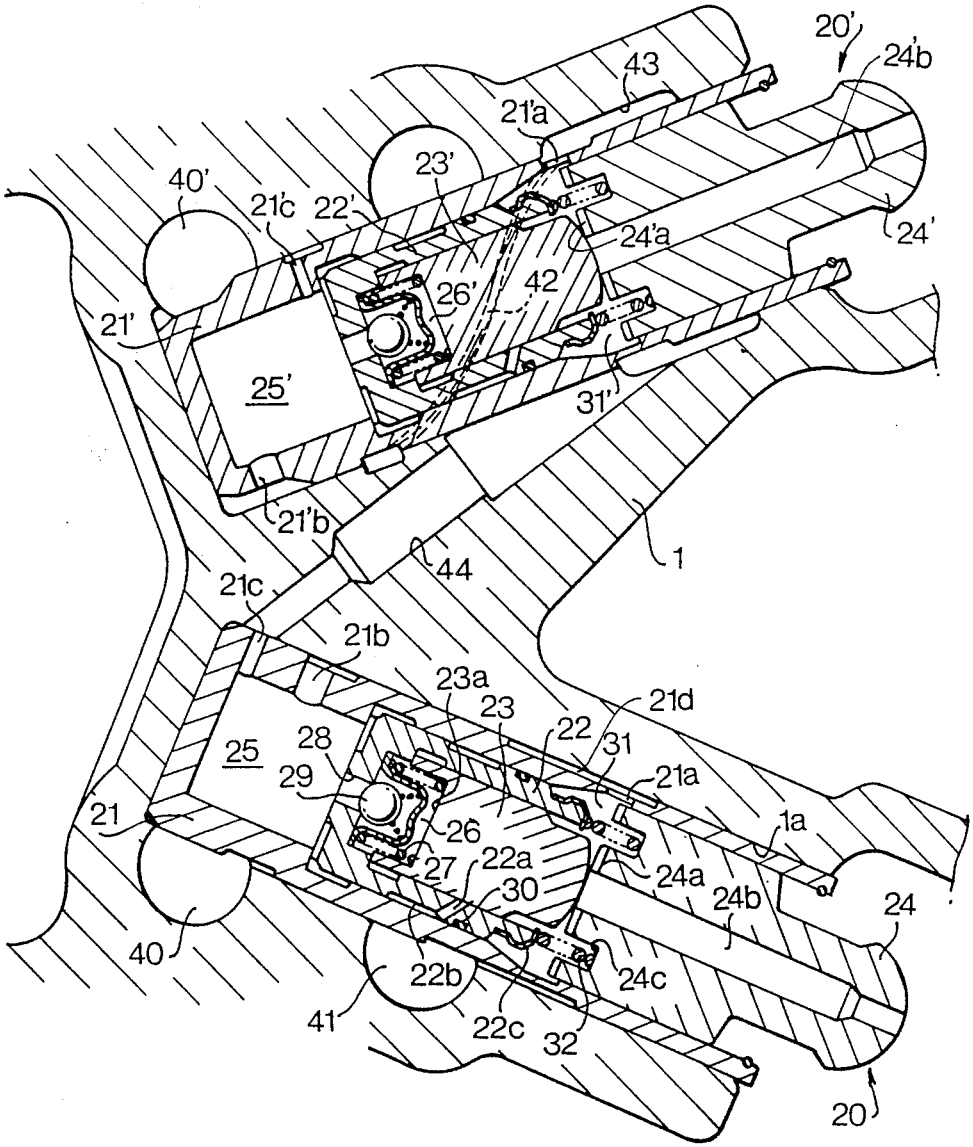
FIG. 2 is an enlarged sectional view showing hydraulic valve-lash adjusters of the valve mechanism.

Referring to FIG. 2, a cylindrical reservoir case 21 having a bottom plate is mounted in a hole la formed in the cylinder head 1 in force fit engagement. A cylindrical body 22 is mounted in the reservoir case 21 and a bottom of the body 22 is fixed to a middle portion in the reservoir case 21. A solid plunger 23 having a recessed bottom **23*a* is slidably mounted in the body 22. A pivot 24 is slidably mounted in the reservoir case 21 and the innermost portion of the pivot 24 engages with the plunger 23. A reservoir chamber 25 is formed between the bottom plate of the reservoir case 21 and an outside of a bottom of the body 22. A high pressure chamber 26 is formed between an inside of the bottom of the body 22 and the recessed bottom 23*a* of the plunger 23. The bottom of the body 22 has a port 28 which is closed by a ball-check valve 29 provided in the high pressure chamber 26. A coil spring 27 is provided between the recessed bottom 23*a* and the bottom of the body 22**.

The body 22 has a port **22*a* radially formed in the cylindrical wall thereof and an annular groove 22*b* circumferentially formed on the outer periphery of the cylindrical wall. An O-ring 30 is provided on the body 22 for sealing the body 22 and the reservoir case 21 so that the oil leaked from the high pressure chamber 26 through the port 22***a* and groove 22*b* is fed back to the reservoir chamber 25. An oil reservoir 31 is formed between the reservoir case 21 and the body 22. The reservoir 31 communicates with a passage 21*a* of the reservoir case 21 and with an axial hole 24*b* formed in the pivot 24 through a groove 24*a* formed on a bottom of the pivot 24. A helper spring 32 is provided in the oil reservoir 31 between the outermost end 22*c* of the body 22 and an annular groove 24*c* formed in the pivot 24 for helping the plunger spring 27.

An oil supply gallery 40, which connected to an oil pump (not shown) is formed in the cylinder head 1 at a bottom portion of the hole 1*a*. The gallery 40 communicates with the reservoir chamber 25 through a passage 21*b* formed in the reservoir case 21. A lubricating gallery 41 is formed in the cylinder head 1 adjacent the passage 21*a* of the case 21 and communicates with the passage 21*a* through an annular groove 21*d* circumferentially formed on the outer periphery of the case 21.

In the hydraulic valve-lash adjuster 20, the reservoir chamber 25 is located higher than the high pressure chamber 26. Accordingly, air in the reservoir chamber 25 stays in the upper corner of the chamber 25 which is most remote from the high pressure chamber 26. A port 21*c* for escaping the air is formed in the upper corner of the case 21.

The hydraulic valve-lash adjuster 20' for the intake valve 5 is similar to the adjuster 20 in structure. An oil supply gallery 40' communicates with a reservoir chamber 25' through a passage 21'*b* of a reservoir case 21'. The reservoir chamber 25' is located lower than a high pressure chamber 26'. Accordingly, air stays in the upper corner of the chamber 25' adjacent a bottom of a body 22', where a port 21'*c* is formed in the reservoir case 21'. The port 21'*c* communicates with a groove 43 formed in the cylinder head 1 through a helical groove 42 formed on the case 21'. The groove 43 further communicates with the port 21*c* of the adjuster 20 through a passage 44. Thus, air stayed in reservoir chambers 25 and 25' escapes from the groove 43 to the atmosphere. A pivot rod 24' and the rocker arm 11 are lubricated with oil passing through the passage 44, groove 43, passage 21'*a*, reservoir 31', groove 24'*a* and axial hole 24'*b*.

Figure 3:
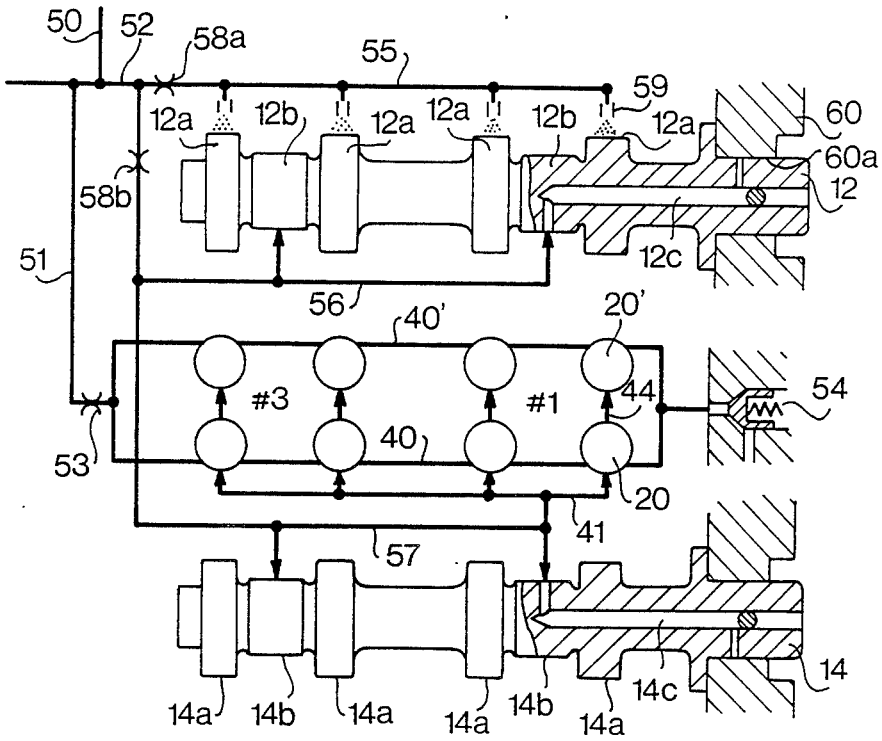
FIG. 3 shows a hydraulic circuit of a lubricating system for the valve mechanism.

Referring to FIG. 3 showing a lubricating system, a main oil gallery 50 is provided for supplying pressurized oil from the oil pump to the valve mechanism. The oil gallery 50 divides into a gallery 51 for the hydraulic valve-lash adjusters 20 and 20' and a gallery 52 for the camshafts 12 and 14. The gallery 51 is provided with an orifice 53 for reducing the pressure of oil and divides into the oil supply galleries 40 and 40'. The oil supply galleries 40 and 40' are disposed in parallel with each other and communicate with a relief valve 54. In accordance with the orifice 53 and the relief valve 54, a constant low pressure of oil is equally produced in galleries 40 and 40'.

The gallery 52 divides into oil galleries 55 and 56 which are disposed in parallel with each other along the camshaft 12. The gallery 56 communicates with a gallery 57 disposed along the camshaft 14. Orifices 58*a*, 58*b* are provided in inlets of the galleries 55 and 56, respectively. As shown in FIG. 1, the oil gallery 55 is provided in the cylinder head 1 at an upper portion of sliding portions of the cam 12*a* and the rocker arm 11. A nozzle 59 of the gallery 55 is opened to the sliding portions for ejecting oil. The oil gallery 56 communicates with cam journals 12*b* of the camshaft 12 and with a passage 12*c* axially formed in the camshaft 12. The passage 12*c* has a small diameter and is opened to an inner periphery 60*a* of a front holder 60 at an end thereof.

Similarly, the oil gallery 57 for the camshaft 14 communicates with journals 14*b* and a passage 14*c* of the camshaft 14. Surfaces of the cams 14*a* are lubricated by oil ejected from nozzle 59. The aforementioned lubricating oil gallery 41 for the hydraulic valve-lash adjuster 20 is divided from the gallery 57.

The passages 12*c* and 14*c* respectively communicate with the oil gallerys 56 and 57 at the cam journals 12*b* and 14*b* neighboring to the holder 60, so that the passages 12*c* and 14*c* are formed between the cam journals 12*b* and 14*b* and the end of the camshaft 12.

The operation of the hydraulic valve-lash adjusters will be described hereinafter. When the engine runs, oil is supplied to the reservoir chamber 25 through the oil supply gallery 40 to fill the chamber 25 with oil and a predetermined amount of oil is applied to the high pressure chamber 26. When the pivot 24 is urged toward the plunger 23 by the cam 14 through the rocker arm 13, oil in the high pressure chamber 26 is pressurized at a high pressure to hold the plunger 23 and the pivot rod 24. Thus, the rocker arm 13 rocks about the pivot 24 to open the exhaust valve 8. When the base circle of the cam 14*a* engages with the rocker arm 13, and the exhaust valve 8 is closed, no load is exerted on the pivot 24. The plunger 23 and the pivot 24 are pushed by pressurized oil in the high pressure chamber 26 and by elastic force of the spring 27 to increase the volume of the chamber 26. Accordingly, the ball-check valve 29 is opened and oil is fed from the reservoir chamber 25 to the high pressure chamber 26 to maintain the engagement of the pivot 24 with the rocker arm 13. The volume of the high pressure chamber 26 varies with the thermal expansion of the exhaust valve 8 to absorb the change of the length of the exhaust valve.

Oil is supplied to the oil reservoir 31 through the lubricating gallery 41 and to the groove 24*a* and the passage 24*b* of the pivot 24 for lubricating sliding portions of the pivot 24 and the rocker arm 13. The oil is further supplied to the space between the reservoir case 21 and the pivot 24 for lubrication. Oil leaked from the high pressure chamber 26 lubricates the plunger 23 and thereafter the oil is fed back to the reservoir chamber 25.

The intake valve 5 is operated in accordance with the hydraulic valve-lash adjuster 20' in the same manner as the above described operation and the adjuster 20' is lubricated by the oil supplied to the oil reservoir 31' through the passage 44. Further, air entering reservoir chambers 25 and 25' together with oil escapes from the ports 21*c* and 21'*c* and is discharged from the groove 43 through the passage 44 and the groove 42. Thus, air is prevented from entering the high pressure chambers 26 and 26'.

Describing the operation of the lubricating system, low pressurized oil produced in galleries 40 and 40' is stably applied to the hydraulic valve-lash adjusters 20 and 20'. Thus, the push-up of the valves 5 and 8 is prevented. Oil is supplied to journals 12*b* and 14*b* of respective camshafts 12 and 14 through oil galleries 56 and 57 and passages 12*c* and 14*c* without leaking. At a high speed of the engine, oil sufficiently applied to the valve mechanism for lubrication. When the engine starts at a low temperature, both passages 12c and 14c are filled with oil immediately after the start because of small volumes of the passages. Accordingly, oil is rapidly supplied to the front holder 60 for lubricating the bearing in the holder, thereby preventing seizure of journals of the camshafts.

The cam 12a and the rocker arm 11 provided in the upper position are directly lubricated by oil ejected from the nozzles 59. The cam 14a and the rocker arm 13 provided in the lower position are lubricated by oil flowing from the upper members. The pivot 24 and the rocker arm 13 of the hydraulic valve-lash adjuster 20 are lubricated by oil supplied through galleries 57 and 41. The pivot 24' and the rocker arm 13' of the valve-lash adjuster 20' are lubricated by oil supplied through the passage 44.

In accordance with the present invention, the hydraulic valve-lash adjusters for the intake valve and the exhaust valve are equally supplied with oil at a constant low pressure. Consequently, push-up of the valve is prevented. Oil is supplied to journals and cams of the camshafts through different oil galleries, so that delay of oil supply and shortage of oil are prevented, thereby preventing seizure of journals. The front holder is applied with oil immediately after starting the engine at low temperature, thereby providing effective lubrication and preventing the seizure at the holder.

While the presently preferred embodiment of the present invention has been shown and described, it is to be understood that this disclosure is for the purpose illustration and that various changes and modifications may be made without departing from the scope of the invention as set forth in the appended claims.

What is claimed is:

1. A lubricating system of a valve mechanism for a double overhead camshaft engine having opposed cylinders, an intake valve and an exhaust valve which are disposed one above the other in a vertical plane, camshafts, rocker arms and hydraulic valve-lash adjusters, characterized in that the system has:

a main oil gallery provided for supplying pressurized oil to the valve mechanism;

a first gallery connected with the main gallery for supplying first lubricating oil to the hydraulic valve-lash adjusters;

means for keeping pressure of the first lubricating oil constant;

a second gallery connected with the main gallery for supplying second lubricating oil to journals of the camshafts;

a third gallery connected with the main gallery;

nozzles connected with the third gallery for ejecting third lubricating oil to the camshaft and rocker arm of the upper valve.

2. The system according to claim 1, wherein the means comprises an orifice and a relief valve provided in the first gallery for maintaining the pressure of the first lubricating oil.

3. The system according to claim 1 further comprising;

front holders for securing ends of the respective camshafts;

the camshafts having respective oil passages between the ends of the camshafts and the journals neighboring to the front holders; and the passages provided for communicating with the second gallery.

* * * * *